United States Patent [19]

Fait

[11] Patent Number: 4,958,387

[45] Date of Patent: Sep. 25, 1990

[54] ADJUSTABLE HINGE ASSEMBLY FOR MOUNTING A SEAT AND/OR COVER TO A SANITARY FIXTURE

[75] Inventor: Claudio Fait, Milan, Italy

[73] Assignee: American Standard Inc., New York, N.Y.

[21] Appl. No.: 357,756

[22] Filed: May 26, 1989

[30] Foreign Application Priority Data

Jun. 8, 1988 [IT] Italy ..... 34852/88[U]

[51] Int. Cl.[5] ..... A47K 3/12

[52] U.S. Cl. ..... 4/236; 4/240; 4/234

[58] Field of Search ..... 4/236, 240, 234, 235; 16/249, 254

[56] References Cited

U.S. PATENT DOCUMENTS

| | | | |
|---|---|---|---|
| 1,194,393 | 8/1916 | Adlar | 4/240 X |
| 1,599,820 | 9/1926 | Kolstad | 4/240 X |
| 4,315,338 | 2/1982 | Harrison | 4/236 |
| 4,391,001 | 7/1983 | Harrison | 4/236 |
| 4,514,356 | 4/1985 | Harrison | 4/236 |
| 4,829,605 | 5/1989 | Agostino | 4/326 |

FOREIGN PATENT DOCUMENTS

| | | | |
|---|---|---|---|
| 839049 | 6/1960 | United Kingdom | 4/240 |

*Primary Examiner*—Henry K. Artis
*Attorney, Agent, or Firm*—Blum Kaplan

[57] ABSTRACT

An adjustable hinge assembly to be fastened to a sanitary fixture, such as a bidet or a toilet, and to a seat and/or cover, is disclosed. The movable hinge element is shaped so as to be insertable into a correspondingly shaped fixed element mounted in the rear of the seat and/or cover, respectively. The movable hinge element is provided with means to fix the movable element at a desired insertion depth so that the front section of the seat and/or cover match the outer peripheral profile of the front upper rim of the fixture.

7 Claims, 1 Drawing Sheet

ADJUSTABLE HINGE ASSEMBLY FOR MOUNTING A SEAT AND/OR COVER TO A SANITARY FIXTURE

BACKGROUND OF THE DISCLOSURE

FIELD OF THE INVENTION

The invention concerns a hinge capable of allowing adjustment of the position of covering elements with respect to their corresponding sanitary fixtures, such as toilets or bidets. In particular, the invention is suitable for the attachment of seat and cover assemblies to toilets in general.

DESCRIPTION OF PRIOR ART

It is known that toilets are manufactured by casting a ceramic slip material inside suitable multi-part molds, the molds being made of a material permeable to liquids. It is also known that a cerain number of castings can be made with a single mold and that, between one casting and another, the shaping cavity of the mold is subject to a small but continuous dimensional change. More specifically, the cavity enlarges, by as much as several millimeters over the service life of a mold, with the result that toilets are dimensionally different, especially if the first ones cast in a particular mold are compared with the last ones cast.

On the other hand, the seat and/or cover assemblies, designed to be fastened subsequently to the toilets, have unvarying dimensions since they are made of synthetic materials which are molded in dimensionally stable molds.

In some cases, when the seat and cover assemblies are installed on their respective toilets, they quite often do not match the outer peripheral profile of the upper rim of the toilet as well as desired. In particular, the front edge of the seat is farther back than the corresponding rim of the toilet, creating a discontinuity or step. This is not only annoying to users but disadvantageous from an aesthetic standpoint.

Moreover, the usual hinge devices used to fasten the seat and cover assemblies do not provide means to adjust the seat and/or cover assemblies to overcome these disadvantages.

SUMMARY OF THE INVENTION

The principal object of this invention is to make available, a hinge assembly capable of eliminating the disadvantages presented above by providing a simple and rational design solution.

According to the invention, the proposed hinge comprises at least two elements, one fixed element and the other one a movable element, one of which is secured to a hole provided at the rear of the sanitary fixture, such as a toilet, and the other of which is fastened to the corresponding covering element, such as the seat of a seat and/or cover assembly. The movable element includes a member which is telescopically positioned into a correspondingly shaped longitudinal chamber formed in the rear of the covering element or seat, and means for adjustably mounting the movable element in fixed position in the chamber. In a preferred form, the movable element is a bar having on one of its surfaces, a tooth rack with very closely spaced interstices, which are capable of accommodating the end of a threaded stud to immobilize the cover or seat at the desired insertion depth.

From the foregoing assembly, there has been provided a hinge assembly to adjust the covering element or seat with respect to the corresponding fixture or toilet and, thus, eliminate the aforesaid problems.

BRIEF DESCRIPTION OF THE DRAWINGS

These and other objects and characteristics of the invention will become evident from the detailed description which follows, given with reference to the attached FIGURES, in which.

DETAILED DESCRIPTION OF THE PREFERRED EMBODIMENT

Figure 1:
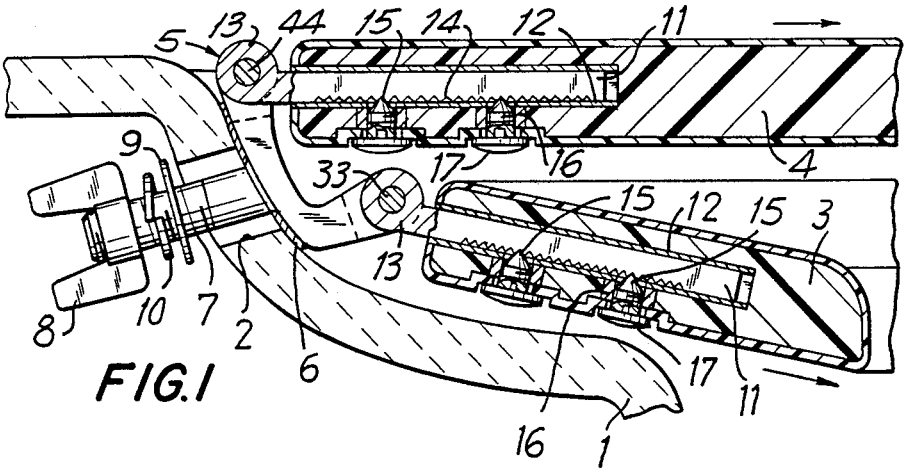
FIG. 1 is an enlarged elevational view, partly in section, taken along line I-I of FIG. 3.

Referring to the drawings and particularly to FIG 1., is an enlarged fragmentary view of a toilet to better illustrate the combination elements forming the invention, particularly for toilets of any configuration and dimensions, and for other sanitary fixtures, such as bidets,.

In FIG. 1, toilet 1 is provided with two through holes 2 at its rear region, which are positioned symmetrically with respect to its vertical plane of symmetry. Each hole 2 is designed for fastening a pair of hinges, forming part of a single element to support and articulate a seat 3 and a cover 4, of which only one of the two hinge assemblies is shown since the other is identical. The hinge is provided with two distinct articulation axes for seat 3 and cover 4 but there is no reason why the latter could not, for example, pivot about a common axis, as is well known to persons skilled in the art.

In FIG. 1, a fixed hinge element 5 is shaped so as to rest on toilet 1 with interpostion of a suitable gasket 6, and from which extends a rear threaded pin or stud 7 that is inserted though hole 2. A threaded nut, such as a wing nut 8, together with a washer 9 and lock washer 10, is threaded onto threaded stud 7 to fix hinge 5 to the rear of toilet 1.

Figure 2:
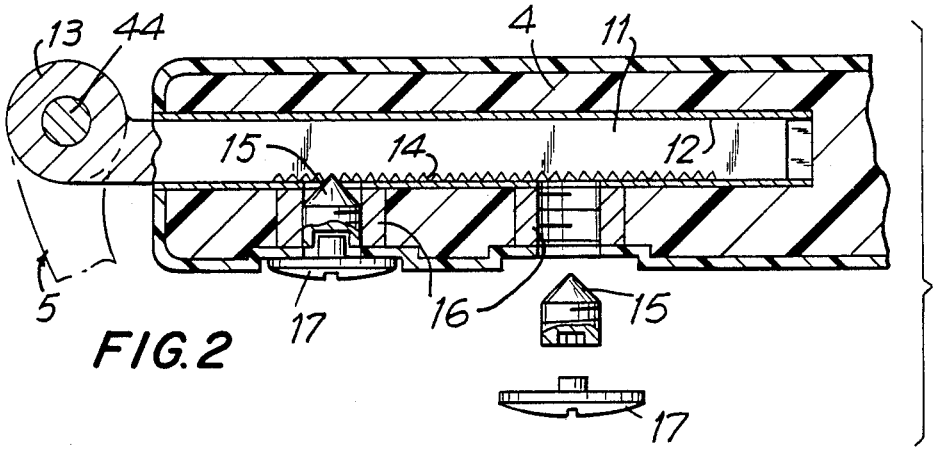
FIG. 2 is an enlarged sectional view of the movable hinge element that is shown at the top of FIG. 1.
Figure 3:
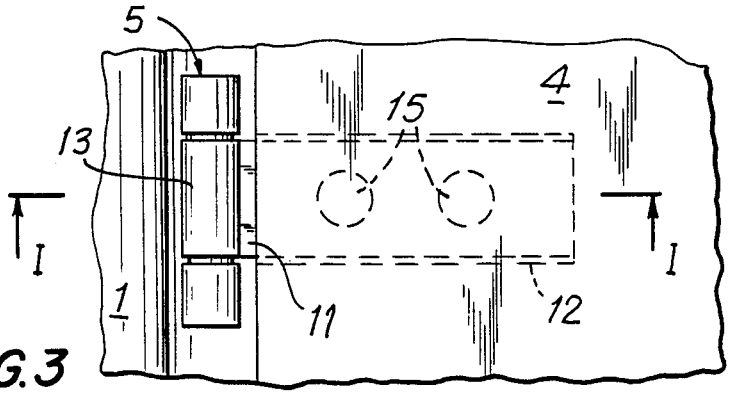
FIG. 3 is a top plan view of FIG. 1, at reduced scale.

Hinge element 5, FIG. 3, includes two superimposed pairs of opposed and fixed knuckles, between which is inserted the movable element of the inge, consisting of bar 11 and pivotal knuckle 13, the latter capable of being aligned with the fixed knuckles to accommodate the articulation pin 44 or 33 of cover 4 and seat 3, respectively. The movable hinge element of both seat 3 and cover 4 consists of a bar 11 or strip which telescopes into a correspondingly box-shaped metal element 12 that is inserted into seat 3 and cover 4, respectively, shown in FIGS. 1 and 2. Box-shaped element 12 is inserted longitudinally into a corresponding well-like chamber formed at the rear of seat 3 and cover 4, shown in FIGS. 1 and 3. As illustrated in FIG. 2, there is present on the lower surface of bar 11, a rack 14 with triangular teeth, the interstices of which are capable of accommodating the pointed ends of the two immobilization and adjustment screws 15.

In FIG. 2, screws 15 are of the headless type or set screws with hexagonal socket heads. Screws 15 are threaded into respective transversely positioned threaded sleeves 16 mounted to box-shaped element 12 and, preferably, are located on the lower surface of cover 4 or seat 3, FIG. 1. Press-in caps 17, preferably having the same color as that of the seat 3 and cover 4, are fitted into threaded sleeve 16 to aesthetically conceal threaded studs 15.

I claim:

1. An adjustable hinge assembly adapted to be fastened to a sanitary fixture, such as a bidet or a toilet, said hinge assembly comprising:

a fixed hinge element to be mounted on the upper rear flat region of said fixture, and an articulating hinge element mounted to said fixed hinge element;

said articulating hinge element having an elongated bar, one end of which is pivotally mounted to said fixed hinge, the other end being insertable into a correspondingly shaped well-like chamber formed in a seat and/or cover for said fixture; and means formed on said elongated bar to cooperate with a latch member adapted to be transversely mounted on said seat and/or cover to releaseably and adjustably fix said articulating member at a desired insertion depth in said well-like chamber so that the front section of the seat and /or cover match the peripheral profile of the front upper rim of said fixture whereby said seat and/or cover can be adjusted with respect to said fixture and can be interchanged with a like seat and/or cover.

2. The adjustable hinge assembly of claim 1 wherein said elongated bar is rectangular and its elongated lower surface is toothed so that when the latch member is transversely mounted on said seat and/or cover, said elongated bar is fixed in its desired position.

3. The adjustable hinge assembly of claim 1 further comprising a tubular metal member adapted to slidingly receive said elongated bar to form a sliding fit therewith, said tubular metal member being insertable into said correspondingly shaped well-like chamber formed in said seat and/or said cover.

4. The adjustable hinge of claim 3 wherein said tubular member is rectangular.

5. The adjustable hinge of claim 3 further includes a threaded sleeve adapted to be inserted transversely of said seat and/or cover so that one end engages said tubular member.

6. The adjustable hinge of claim 4 wherein a headless threaded stud threads into said thread sleeve, the forward end of which latches said elongated bar in fixed position.

7. In combination, an adjustable hinge assembly adapted to be fastened to a sanitary fixture, such as a bidet or toilet, and a seat and/or cover pivotally mounted thereto; said hinge assembly adapted to be mounted to the flat rear reagion of said fixture and an articulating hinge element, one end of which is pivotally mounted to said fixed hinge element, and the other end of which is adjustably mounted to said seat and/or cover; said articulating hinge element having an elongated bar, one end of which is adjustablu insertable into a correspondingly shaped well-like chamber formed in said seat and/or cover for said fixture; and means formed on said elongated bar which cooperates with a latch member transversely mounted on said seat and/or cover to releaseably and adjustably fix said articulating member at a desired insertion depth in said well-like chamber so that the front section of the seat and/or cover match the peripheral profile of the front upper rim of said fixture whereby said seat and/or cover can be adjusted with respect to said fixture and can be interchanged with a like seat and/or cover.

* * * * *